US010801738B2

(12) United States Patent
Haynes

(10) Patent No.: US 10,801,738 B2
(45) Date of Patent: Oct. 13, 2020

(54) FURNACE

(71) Applicant: Fire Chief Industries LLC, St. Louis, MO (US)

(72) Inventor: Danny N. Haynes, Byrnes Mill, MO (US)

(73) Assignee: FIRE CHIEF INDUSTRIES LLC, St. Louis, MO (US)

( * ) Notice: Subject to any disclaimer, the term of this patent is extended or adjusted under 35 U.S.C. 154(b) by 187 days.

(21) Appl. No.: 15/673,376

(22) Filed: Aug. 9, 2017

(65) Prior Publication Data

US 2019/0049122 A1 Feb. 14, 2019

(51) Int. Cl.

| | |
|---|---|
| ***F24D 19/10*** | (2006.01) |
| ***F23L 1/00*** | (2006.01) |
| ***F23L 9/02*** | (2006.01) |
| ***F23L 9/06*** | (2006.01) |
| ***F24B 7/02*** | (2006.01) |

(Continued)

(52) U.S. Cl.

CPC ..... *F24D 19/1084* (2013.01); *F23L 1/00* (2013.01); *F23L 9/02* (2013.01); *F23L 9/06* (2013.01); *F23N 3/087* (2013.01); *F24B 7/025* (2013.01); *F24D 5/04* (2013.01); *F24H 3/067* (2013.01); *F24H 9/0063* (2013.01); *F24H 9/0073* (2013.01); *F24H 9/189* (2013.01); *F24H 9/2092* (2013.01); *F24H 2230/00* (2013.01)

(58) Field of Classification Search

CPC ..... F24B 1/026; F24B 1/185
USPC ..... 237/11
See application file for complete search history.

(56) References Cited

U.S. PATENT DOCUMENTS

| | | | |
|---|---|---|---|
| 1,689,067 | A | 10/1928 | Benner |
| 2,752,144 | A | 6/1956 | Oldenkamp et al. |

(Continued)

FOREIGN PATENT DOCUMENTS

| | | | |
|---|---|---|---|
| DE | 202011000775 | U1 | 6/2011 |
| EP | 0251269 | A2 | 1/1988 |

(Continued)

OTHER PUBLICATIONS

Fire Chief Furnace, Wood and Coal Burning Indoor Furnace, Models: FC500E, FC700E, FC1100E, Manufactured by Fire Chief Industries, 10950 Linpage Place, Saint Louis, MO 63132, Revision VII, Nov. 2013, 26 pages.

*Primary Examiner* — Steven B McAllister
*Assistant Examiner* — John E Bargero
(74) *Attorney, Agent, or Firm* — David E. Crawford; Crawford IP Law

(57) ABSTRACT

A furnace including a housing and a firebox in the housing having a combustion chamber. The furnace includes a combustion air delivery system for delivering combustion air to the combustion chamber. The combustion air delivery system includes a manifold mounted outside the combustion chamber and extending vertically along the front face of the combustion chamber from a lower end to an upper end. An air blower is mounted on the manifold. The combustion air delivery system includes a primary combustion air passage for delivering air from the air blower to a primary combustion air outlet at the front face of the combustion chamber. The combustion air delivery system includes a secondary combustion air passage for delivering air to a secondary combustion air outlet positioned inside the combustion chamber adjacent the top face of the combustion chamber.

18 Claims, 7 Drawing Sheets

(51) Int. Cl.

| | |
|---|---|
| ***F24H 9/00*** | (2006.01) |
| ***F23N 3/08*** | (2006.01) |
| ***F24D 5/04*** | (2006.01) |
| ***F24H 3/06*** | (2006.01) |
| ***F24H 9/18*** | (2006.01) |
| ***F24H 9/20*** | (2006.01) |

(56) References Cited

U.S. PATENT DOCUMENTS

| | | | | |
|---|---|---|---|---|
| 3,391,102 | A | | 7/1968 | Major |
| 3,981,292 | A | | 9/1976 | Lilly et al. |
| 4,026,263 | A | | 5/1977 | Boyd |
| 4,078,541 | A | | 3/1978 | Roycraft |
| 4,166,444 | A | | 9/1979 | Martenson |
| 4,193,387 | A | | 3/1980 | Cline |
| 4,201,186 | A | | 5/1980 | Paquin |
| 4,201,187 | A | | 5/1980 | Skow |
| 4,206,743 | A | | 6/1980 | Niemela |
| 4,213,404 | A | | 7/1980 | Spaulding |
| 4,214,569 | A | | 7/1980 | Heine |
| 4,215,669 | A | | 8/1980 | Kerch |
| 4,263,887 | A | | 4/1981 | Dowdall |
| 4,265,214 | A | | 5/1981 | Rasmussen |
| 4,287,871 | A | | 9/1981 | Schumann et al. |
| 4,304,215 | A | | 12/1981 | Jarman |
| 4,316,444 | A | | 2/1982 | Gullickson |
| 4,343,288 | A | | 8/1982 | Tjosvold |
| 4,343,289 | A | | 8/1982 | Zimmerman |
| 4,350,139 | A | | 9/1982 | Robichaud |
| 4,360,000 | A | | 11/1982 | Down |
| 4,404,953 | A | | 9/1983 | Thulman et al. |
| 4,409,955 | A | | 10/1983 | Christian |
| 4,438,756 | A | | 3/1984 | Chamberlain et al. |
| 4,466,358 | A | | 8/1984 | Christian |
| 4,502,395 | A | | 3/1985 | Barnett |
| 4,545,360 | A | | 10/1985 | Smith et al. |
| 4,549,522 | A | | 10/1985 | Savignac |
| 4,603,683 | A | | 8/1986 | Craver |
| 4,621,610 | A | | 11/1986 | Tomooka |
| 4,643,165 | A | | 2/1987 | Chamberlain |
| 4,779,795 | A | | 10/1988 | Winmill |
| 4,829,914 | A | | 5/1989 | Boucher |
| 4,832,000 | A | * | 5/1989 | Lamppa ..... F24B 5/026 126/66 |
| 4,854,298 | A | | 8/1989 | Craver |
| 5,009,219 | A | | 4/1991 | Liet |
| 5,139,008 | A | | 8/1992 | Timpano |
| 5,263,471 | A | | 11/1993 | Shimek et al. |
| 5,341,794 | A | | 8/1994 | Henry et al. |
| 5,462,043 | A | * | 10/1995 | Rose ..... F23L 5/02 126/110 E |
| 5,553,604 | A | | 9/1996 | Frei |
| 5,622,161 | A | | 4/1997 | Stack |
| 5,702,244 | A | | 12/1997 | Goodson et al. |
| 5,893,358 | A | | 4/1999 | Whitfield |
| 5,947,112 | A | | 9/1999 | Hawkinson |
| 5,996,575 | A | | 12/1999 | Shimek et al. |
| 6,595,199 | B1 | | 7/2003 | Andersen et al. |
| 6,817,354 | B2 | | 11/2004 | Laitinen |
| 8,464,704 | B2 | | 6/2013 | Brown |
| 8,869,788 | B2 | | 10/2014 | Brooks et al. |
| 2009/0120338 | A1 | | 5/2009 | Adendorgg et al. |
| 2010/0058998 | A1 | | 3/2010 | Andrae |
| 2011/0132349 | A1 | | 6/2011 | Sulzer |
| 2013/0186313 | A1 | | 7/2013 | Walborn et al. |
| 2013/0206129 | A1 | | 8/2013 | Brooks et al. |
| 2014/0202092 | A1 | | 7/2014 | Bostic |

FOREIGN PATENT DOCUMENTS

| | | | |
|---|---|---|---|
| WO | 9319327 | A1 | 9/1993 |
| WO | 0050817 | A1 | 8/2000 |
| WO | 2013126021 | A1 | 8/2013 |

* cited by examiner

FURNACE

BACKGROUND

The present disclosure relates generally to a furnace, and more particularly to a furnace for heating a space such as an interior of a building.

Furnaces, which we sometimes referred to as heaters, heat fluid such as air. The heated fluid is transported to a space where it is used to heat the space. Some furnaces burn solid fuel, such as wood or coal. Conventional wood-burning, forced-air furnaces include a firebox where the fuel burns and some type of heat exchanger for transferring heat generated by the burning fuel to air that is transported to the space through hot air ducts. Cooler air returns from the space to the furnace where it is heated and delivered to the space. Circulating air from the space rather than drawing air from outside the space provides warmer air to the furnace so less fuel is required to heat the air to a desired temperature before transporting the heated air to the space. Thus, the furnace draws air for the space through cold air return ductwork. The air is heated by the furnace before returning to the space through hot air ductwork.

Some conventional furnaces of this type suffer from inefficient fuel burn and inefficient heat transfer, as well as, high emissions of undesirable combustion by-products. In addition, these furnaces require maintenance and repair for desired emissions performance and long-term use. For example, furnaces with electronic controls require electronic component replacement or updates. Furthermore, during power outages, the electronic control may not operate, which can render the furnace unusable and potentially damage the furnace. Some prior art furnaces compensate for low efficiency fuel burn with catalytic emissions reduction systems to remove undesirable combustion by-products from combustion gases. Unfortunately, such catalytic systems are expensive, prone to blockage, and frequently ineffective at low gas temperatures. Thus, there is a need for a furnace that burns fuel more efficiently and efficiently transfers heat from combustion gases to fluid. Moreover, there is a need for a furnace having control system simplicity so that it can stay in service for extended periods without extensive maintenance.

SUMMARY

One aspect of the present disclosure relates to a forced-air furnace, comprising a housing having a top, a bottom opposite the top, a front, a back opposite the front, and opposite sides extending between the top and the bottom and between the front and the bottom. Further, the furnace includes a firebox in the housing having a combustion chamber adapted for receiving fuel to be combusted and producing products of combustion. The combustion chamber includes a front face adjacent the front of the housing, a rear face opposite the front face, a top face below which the fuel is combusted and a bottom face above which the fuel is combusted. In addition, the furnace includes a combustion air delivery system for delivering combustion air to the combustion chamber. The combustion air delivery system includes a manifold mounted outside the combustion chamber and extending vertically along the front face of the combustion chamber from a lower end to an upper end. The combustion air delivery system also includes an air blower mounted an the manifold for blowing air through the manifold from the lower end to the upper end. Further, the combustion air delivery system includes a primary combustion air passage in fluid communication with the lower end of the manifold for delivering air from the air blower to a primary combustion air outlet entering the combustion chamber exclusively at the front face of the combustion chamber adjacent the bottom face of the combustion chamber. The primary combustion air passage delivers primary combustion air to the combustion chamber during combustion, burning the fuel and forming products of combustion. Moreover, the combustion air delivery system includes a secondary combustion air passage in fluid communication with the lower end of the manifold for delivering air from the air blower to a secondary combustion air outlet positioned inside the combustion chamber adjacent the top face of the combustion chamber. The secondary combustion air passage delivers secondary combustion air to the combustion chamber, burning a portion of the products of combustion.

In another aspect of the disclosure, a forced-air furnace for heating a space includes a forced-air furnace comprising a housing having a top, a bottom opposite the top, a front, a back opposite the front, and opposite sides extending between the top and the bottom and between the front and the bottom. Further, the forced-air furnace includes a firebox in the housing having a combustion chamber adapted for receiving fuel to be combusted and producing products of combustion. The combustion chamber includes a front face adjacent the front of the housing, a rear face opposite the front face, a top face below which the fuel is combusted and a bottom face above which the fuel is combusted. The firebox has a post-combustion chamber positioned above the combustion chamber. The post-combustion chamber receives products of combustion from the combustion chamber exclusively adjacent the front face of the combustion chamber and transports the products of combustion to an exhaust port adjacent a back of the housing. The furnace also includes a lower plenum positioned below the combustion chamber, a forced-air fan adapted to selectively blow air into the lower plenum, and a pair of passages. Each passage transports air upward from the lower plenum along a corresponding opposite side of the combustion chamber. In addition, the furnace has an upper plenum partially surrounding the post-combustion chamber for transferring heat from the products of combustion in the post-combustion chamber to air travelling through the upper plenum. The upper plenum includes lower portions on opposite sides of the post-combustion chamber and an upper portion above the post-combustion chamber having a duct connection port adjacent the rear wall of the housing through which air exits the upper plenum. Each of the lower portions of the upper plenum receive air from a corresponding passage of the pair of passages and direct the received air upward along the corresponding side of the post-combustion chamber to the upper portion. The upper portion directs air from the lower portions of the upper plenum rearward to the duct connection port.

Other features of the present disclosure will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DRAWINGS

Figure 1:
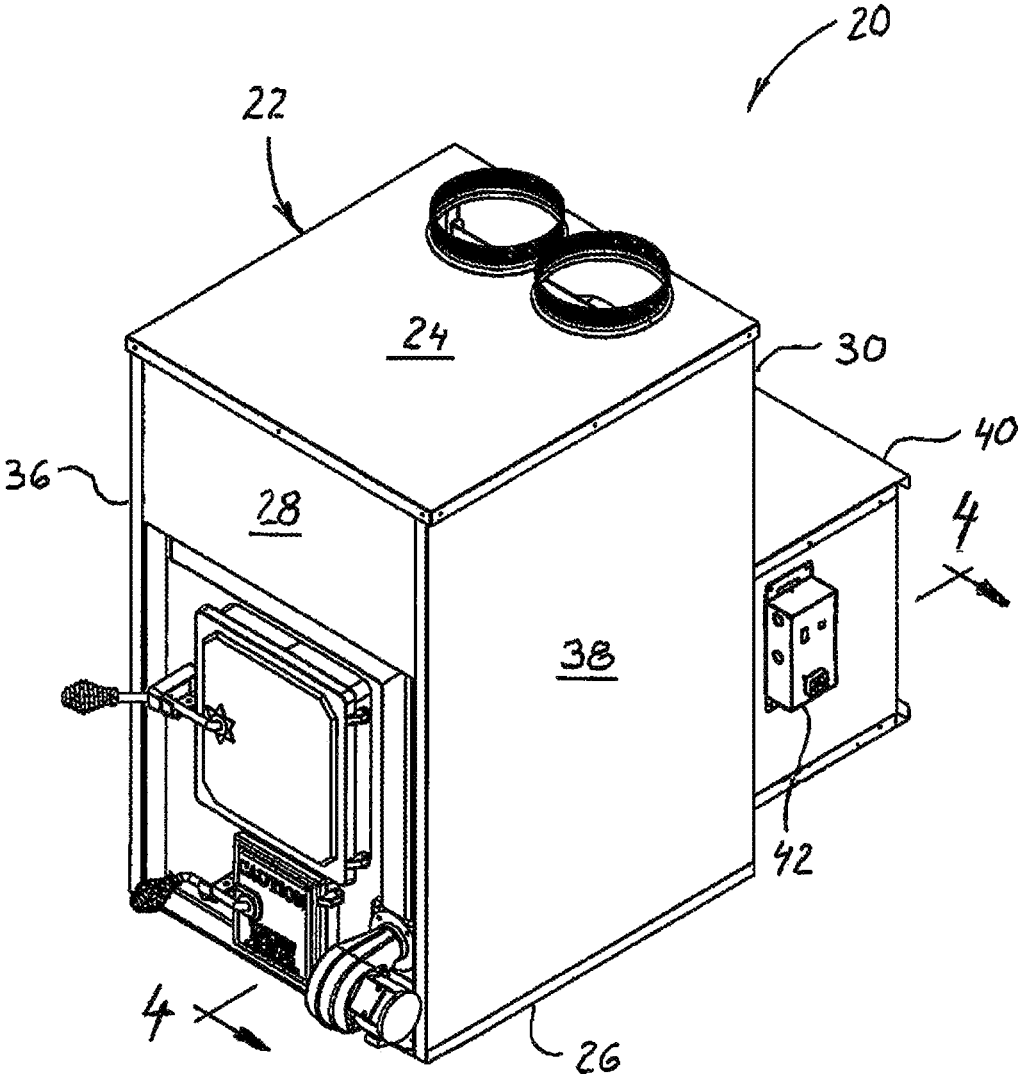
FIG. 1 is a front perspective of a furnace described below.

As illustrated in FIG. 1, a furnace is designated in its entirety by the reference number 20. The furnace 20 heats air (more broadly, fluid) that is transported to a space such as an interior of a building (not shown) remote or adjacent the furnace to heat the space. The illustrated furnace 20 is intended for indoor use in a forced-air heating system. The furnace 20 is particularly adapted to burn solid wood fuel. As described in further detail below, the furnace 20 heats air on demand and blows the heated air toward the space for heating the space.

Figure 2:
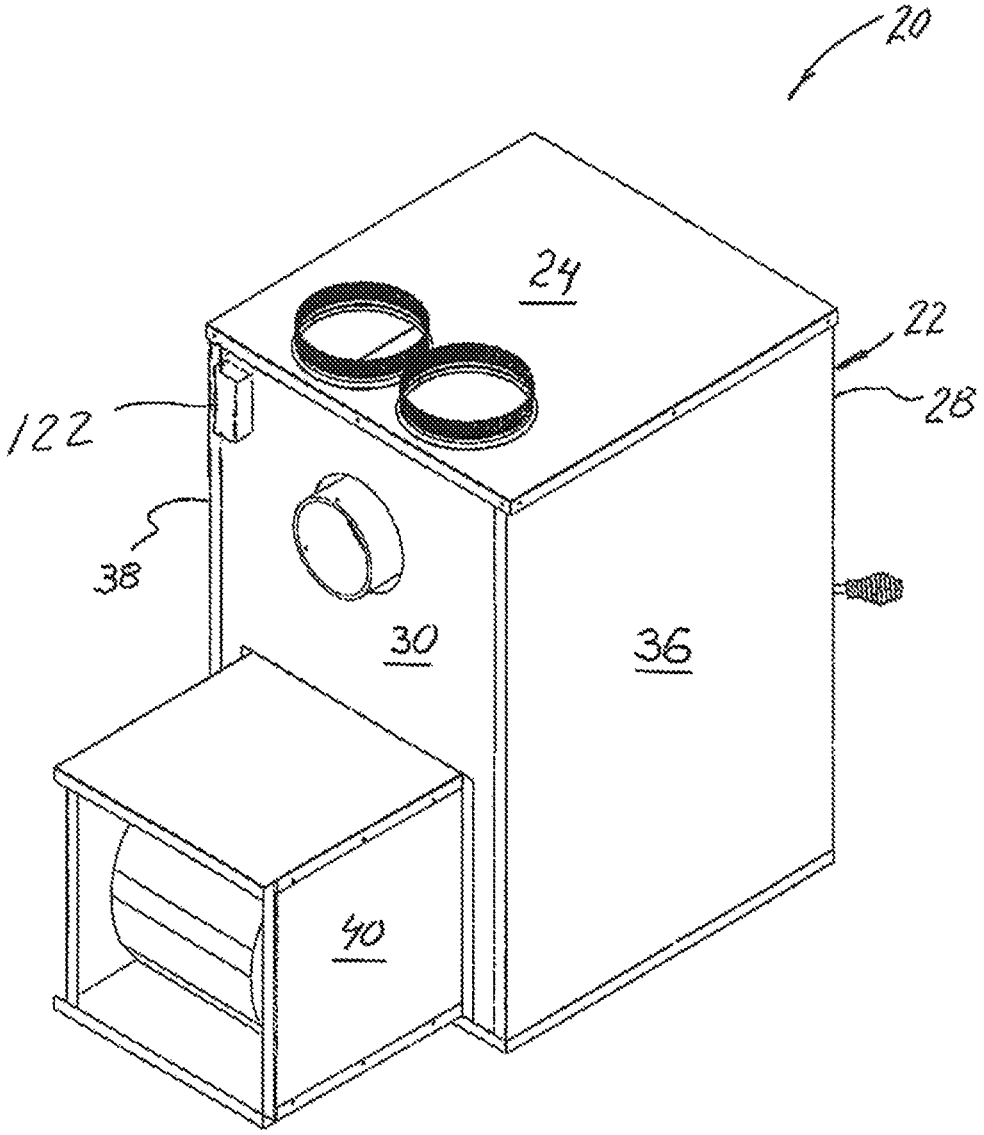
FIG. 2 is a rear perspective of the furnace of FIG. 1.

As shown in FIGS. 1 and 2, the furnace 20 has a housing, generally designated by 22. The housing 22 includes a top defined at least in part by an upper wall 24 and a bottom defined at least in part by a lower wall 26 opposite the upper wall. The lower wall 26 remains cool enough that it can rest directly on a suitable supporting surface (not shown) without burning the surface. The housing 22 also includes a front defined at least in part by a front wall 28 and a back defined at least in part by a rear wall 30 opposite the front wall. In addition, the housing 22 includes left and right sides defined at least in part by opposite left and right-side walls 36, 38, respectively, generally extending between the front and back walls 28, 30, and between the upper and lower walls, 24, 26. A fan housing 40 is attached to the back wall 30, and a fan control 42 is attached to a side of the fan housing as shown in FIG. 1. Although the walls may be fabricated from other materials, the walls of the illustrated housings are made from a suitable sheet material such as steel (e.g., 22 gauge galvannealed steel sheet). Once fabricated, the walls are assembled using conventional means such as screws, rivets, or spot welding. Further, it is envisioned the walls may be thermally insulated but it has been found that suitable insulation surrounding the firebox reduces a need to insulate the walls. As will be appreciated by those skilled in the art, housings having other shapes and configurations are contemplated. Housings having other configurations and shapes are also envisioned.

Figure 3:
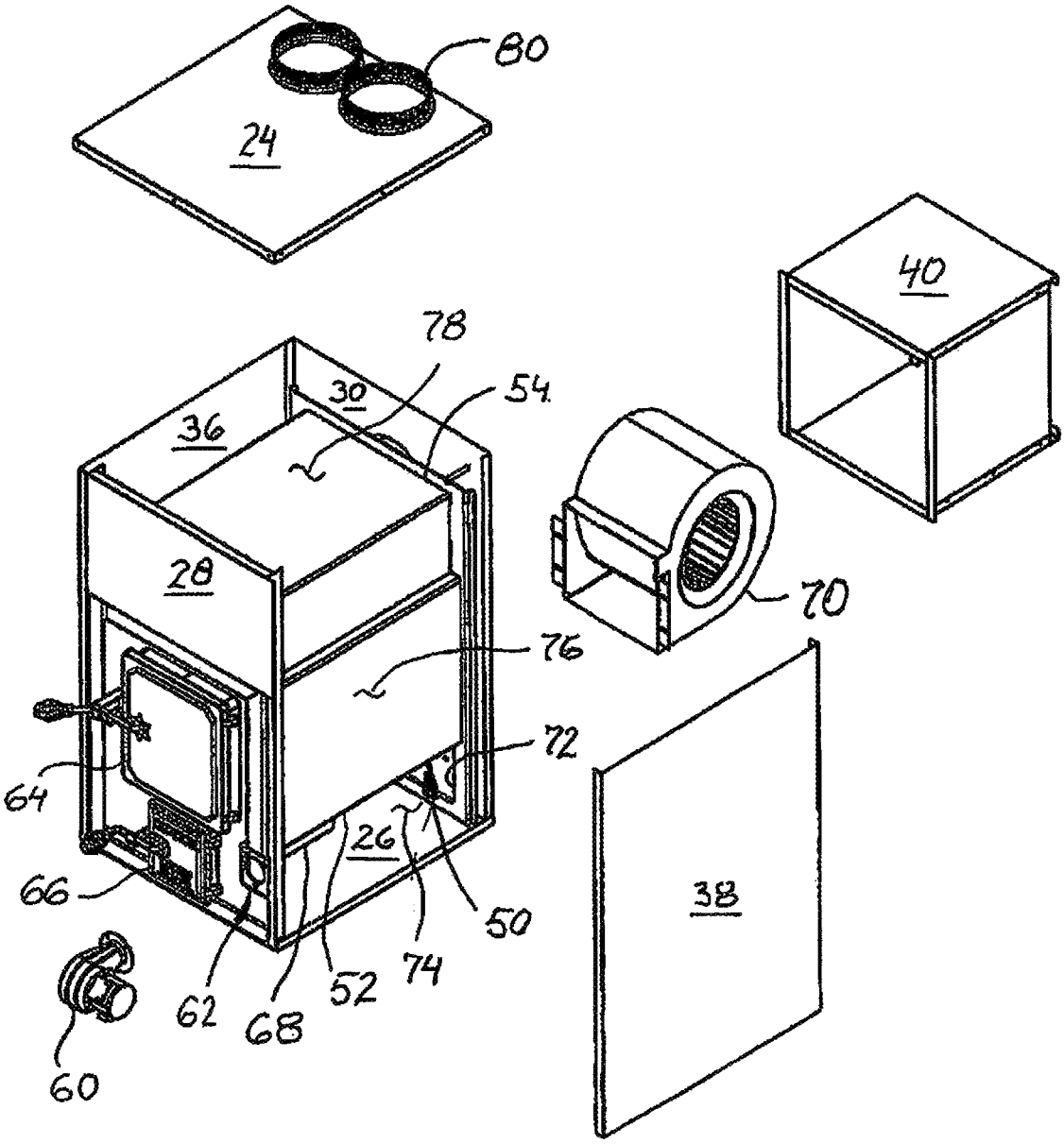
FIG. 3 is a front perspective of the furnace showing components separated.

Referring to FIG. 3, the housing 22 has a hollow interior that houses a firebox generally designated by 50. The firebox 50 includes a combustion chamber 52, in which fuel is burned, and a post-combustion chamber 54, through which combustion gases travel before exiting through an exhaust part 56 (FIG. 4) configured to connect to a vent (not shown) that carries carbon monoxide and other combustion gases outside away from inhabited areas. In the illustrated furnace, the combustion chamber 52 is sized to hold about 414 cubic feet of fuel with sufficient roam to permit oxygen to reach surfaces of the fuel for burning. It will be understood that the furnace with this combustion chamber capacity is suitable for heating a space consisting of an entire building. Other combustion chamber sizes are envisioned. Although the combustion chamber 52 may be fabricated from other materials, the illustrated chamber is made from a suitable plate material such as steel (e.g., 10 gauge cold rolled steel sheet). The post-combustion chamber 54 shown in the drawings has an exposed surface area of about 1152 square inches and is made from suitable sheet or plate material such as steel (e.g., 10 gauge cold rolled steel sheet).

An air blower 60 mounts on a combustion air delivery system, generally designated by 62, at the front of the housing 22 to deliver oxygen, as well as, other atmospheric gases to the firebox 50 to improve fuel burn in the combustion chamber 52 as will be described below. Although air blowers having other specifications may be used depending upon flow areas and furnace sizes, the illustrated blower delivers air at a rate of about fifty cubic feet per minute. It is also envisioned that blowers capable of delivering variable flowrates could be used in alternative furnace configurations to deliver different amounts of air to the combustion air delivery system 62.

A fuel door 64 provided on the front of the firebox 50 allows access to the combustion chamber 52 to load fuel. The fuel door 64 normally remains closed during furnace operation to ensure proper air flow through the furnace as will be explained below. An ash removal door 66 mounted below the fuel door 64 provides access to an ash collection chamber 68 mounted below the combustion chamber 52 for removing ash and other solid by-products of combustion. As further illustrated in FIG. 3, a forced-air fan 70 mounted in the fan housing 40 pushes air through the furnace 20 to heat the air for delivery to the space being heated. Conventional cold air return ductwork (not shown) connects to an open back of the fan housing 40 for delivering cooler air from the space to the furnace 20 for heating. The fan 70 blows the cooler air into the furnace housing 22 through an opening 72 in the rear wall 30 adjacent the bottom wall 26. As will be explained in further detail below, air entering the furnace 20 is directed into a lower plenum 74, then upward through passages 76 formed between each side of the firebox 50 and the corresponding side wall 36, 38 of the housing 22, as well as, between at least portions of the front and back of the firebox and the corresponding front and back walls 28, 30 of the housing. After traveling through the passages 76, the air flows into an upper plenum 78 and ultimately through duct connection ports 80 configured to connect to heating ductwork (not shown) that transports the heated air to the space being heated.

Figure 4:
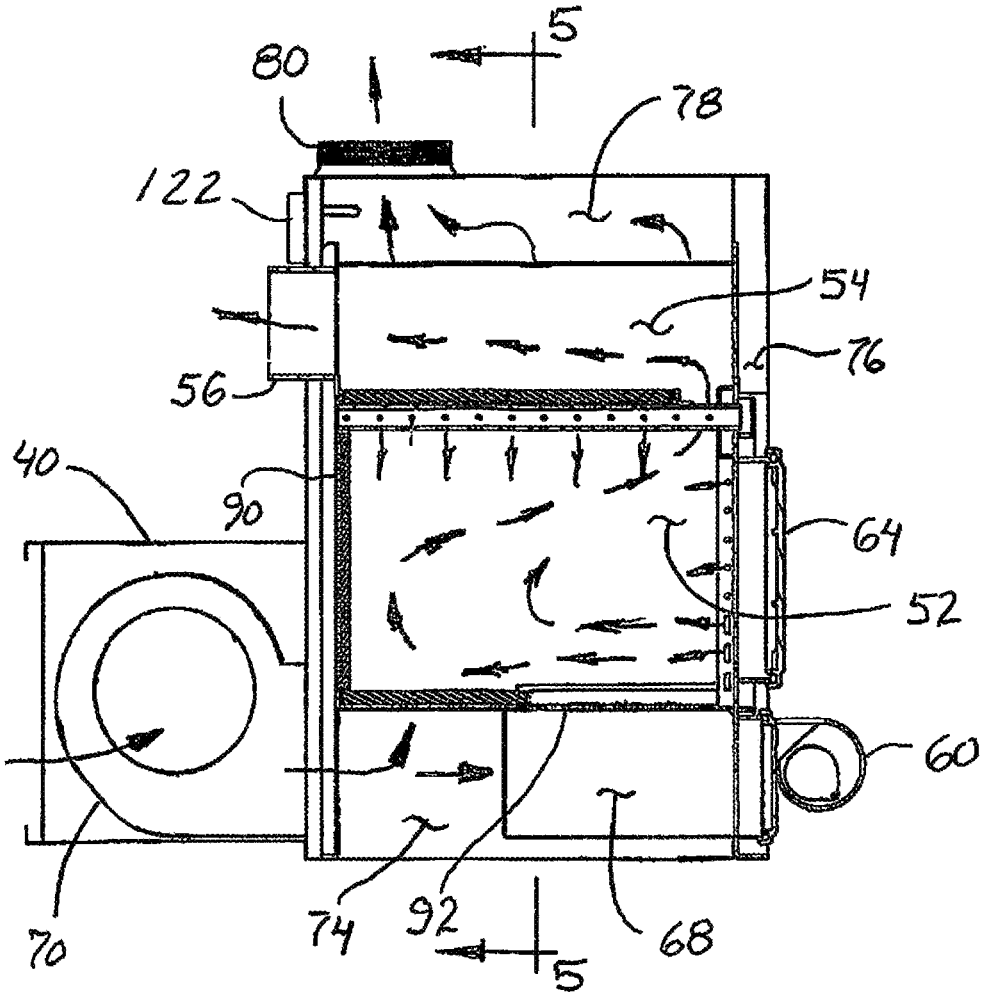
FIG. 4 is a cross section of the furnace taken in a plane corresponding to line 4-4 of FIG. 1.
Figure 5:
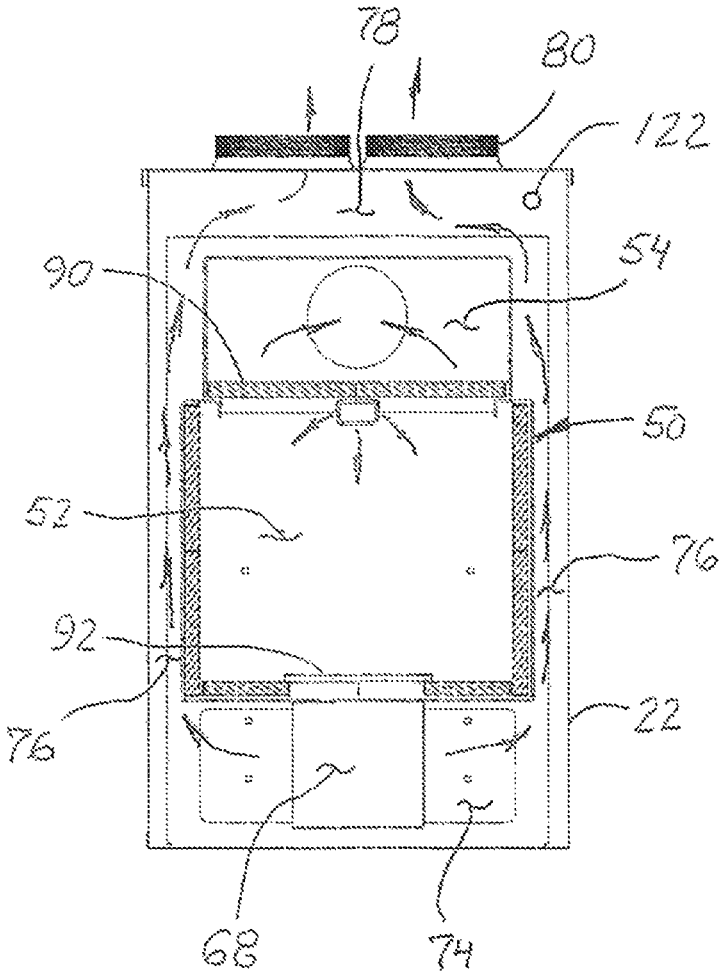
FIG. 5 is a cross section of the furnace taken in a plane corresponding to line 5-5 of FIG. 4.

FIGS. 4 and 5 illustrate cross sections showing various aspects of the furnace 20 described above. Insulative panels 90 (e.g., fire brick) surround the combustion chamber 52 to prevent heat loss from the chamber. As a result, the combustion chamber 52 can burn fuel at higher temperatures than an uninsulated combustion chamber. Higher burning temperatures reduce emissions. Further, the insulative panels 90 prevent heat transfer to air traveling through lower portions of the passages 76 beside the combustion chamber so the side walls 36, 38 of the housing 22 remain cooler than they would otherwise be. A grate (or more broadly, a fuel support) 92 is provided at the bottom of the combustion chamber 52 to support solid wood fuel in the combustion chamber but to permit ash and other solid debris to fall into the ash chamber.

Figure 6A:
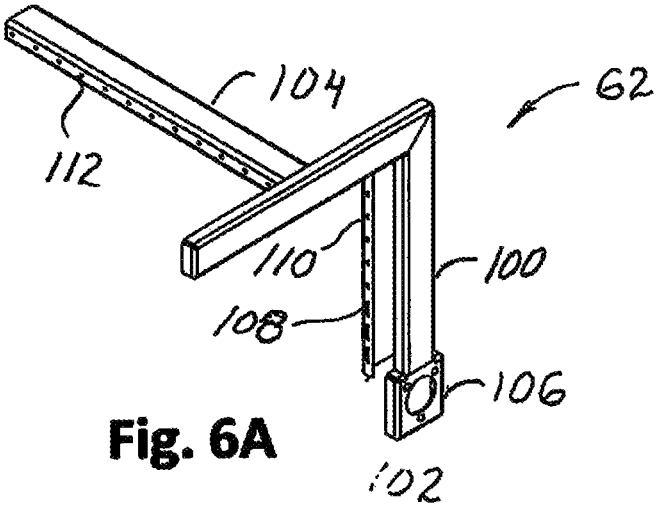
FIGS. 6A, 6B, and 6C are perspectives of components of a combustion air delivery system of the furnace.
Figure 6B:
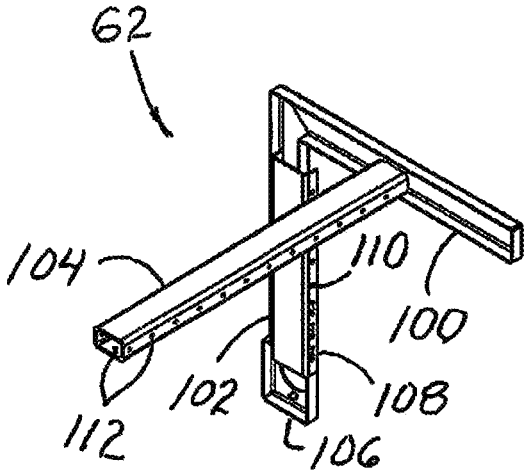
Figure 6C:
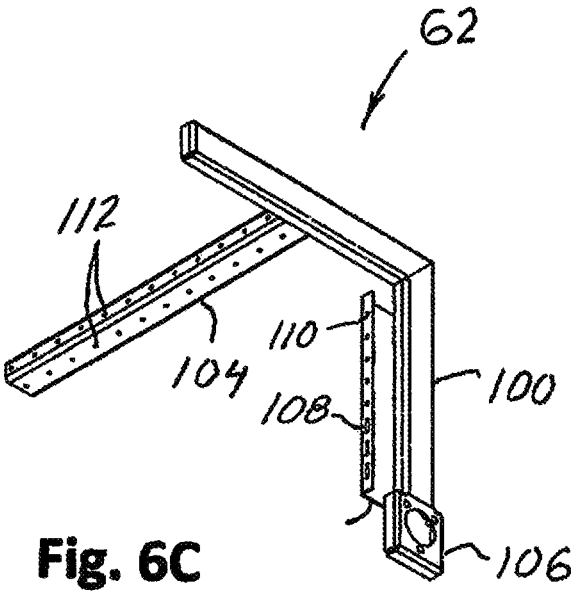

As shown in FIG. 4 and FIGS. 6A-6C, the combustion air delivery system 62 includes a combustion air supply manifold 100 that directs air from the air blower 60 (FIG. 3) to a primary air delivery passage 102 and a secondary air delivery passage 104. The primary and secondary air deliver passages deliver primary and secondary combustion air, respectively, to the combustion chamber 52. The combustion chamber 52 burns fuel in a primary zone fed by primary combustion air. Combustion gases rising from the primary zone continue to burn in a secondary zone fed by secondary combustion air to provide a cleaner, more complete burn. As their names imply, the primary air delivery passage 102 provides primary combustion air to the primary zone and the secondary air delivery passage 104 provides secondary combustion air to the secondary zone. As shown in FIGS. 6A-6C, the combustion air supply manifold 100 is formed by channel extending upward along an outer face of the combustion chamber 52 from a mount 106 to which the air blower 60 mounts. The manifold 100 is welded to the outer face of the combustion chamber 52 so the combustion chamber wall forms a fourth side of the manifold. The manifold 100 extends upward adjacent the hinged side of the fuel door 64 before turning to cross the width of the combustion chamber 52 above the fuel door. Although the combustion air supply manifold may be made of other materials, the illustrated manifold 100 is fabricated from 2.5 inches by 1.0 inch C-channel having a thickness of about 10 gauge made from cold rolled steel. Two openings are formed through the combustion chamber wall forming the fourth side of the manifold 100. A first opening having a flow area of about 5.0 square inches is positioned at the level of the bottom of the fuel door 64. A second opening having a flow area of about 3.1 square inches is positioned over the center of the fuel door 64. As will be apparent to those skilled in the art, the flow areas of the two openings determine a ratio of combustion air supplied to the primary air delivery passage 102 and the secondary air delivery passage 104.

As further illustrated in FIGS. 6A-6C, the primary air delivery passage 102 is formed by channel extending upward along an inner face of the combustion chamber 52. The channel is positioned so its lower end covers the first opening through the combustion chamber wall forming the fourth side of the manifold 100 so air passing through the first opening is directed upward through the channel. Although the primary air delivery passage may be made from other materials, the channel forming the illustrated passage 102 is fabricated from 2.5 inches by 1.0 inch C-channel having a thickness of about 10 gauge and made from cold rolled steel. As shown in FIG. 4, the channel forming the primary air delivery passage 102 has a series of openings along one side facing the fuel door 64. The series of openings includes larger openings 108 along a lower portion of the primary air delivery passage 102 and smaller openings 110 along an upper portion of the passage. Although other quantities, shapes, and sizes are envisioned, the illustrated primary air delivery passage 102 has three slot-shaped larger openings 108 each having a flow area of about 0.33 square inch. The larger openings 108 direct most of the air entering the primary air delivery passage 102 to the primary zone of the combustion chamber 52 to burn the fuel, creating combustion gases that rise into the secondary zone of the combustion chamber. Although other quantities, shapes, and sizes are envisioned, the illustrated air delivery passage 102 has five smaller openings 110, each having a diameter of about 0.31 inch. The smaller openings 110 feed smaller amounts of air into the combustion chamber 52 from the primary air delivery passage 102. Although air entering the combustion chamber through the smaller openings 110 feeds combustion in the secondary zone, it also insulates the fuel door 64 from heat generated by combustion and helps keep combustion gases in the firebox 50 when the door is open.

The secondary air delivery passage 104 is formed by a tube extending along an upper inner face of the combustion chamber 52 formed by the insulative panels 90. The passage 104 extends front to back along a central plane of the combustion chamber 52. Although the secondary air delivery passage may be made from other materials, the tube forming the illustrated passage 104 is fabricated from 2.0 inches by 1.0 inch rectangular tubing having a thickness of about 0.188 inch and made from tube steel. As shown in FIGS. 6A-6C, the tube forming the secondary air delivery passage 104 has a series of openings 112 along its bottom face and both side faces. Although other quantities, shapes, and sizes are envisioned, each face of the illustrated secondary air delivery passage 104 has twelve equally spaced openings 112, each having a diameter of about 0.250 inch. The openings 112 direct air from the secondary air delivery passage 104 to the secondary zone of the combustion chamber 52 to burn combustion gases created in the primary zone of the combustion chamber. As will be understood by those skilled in the art, burning combustion gases from a primary zone produces cleaner post-combustion gases and reduces harmful emissions.

Combustion in the combustion chamber 52 shown in the drawings is fueled by solid wood fuel and oxygen delivered with air by the combustion air delivery system 62. Referring to FIGS. 3-5 and 7, the air blower 60, which overlies the inlet of the manifold 100, is thermostatically controlled to operate in a forced draft mode and a natural draft mode, to automatically generate desired fuel burn and heat, as explained in further detail below. The primary air delivery passage 102 is exposed to combustion gases inside the combustion chamber 52 to preheat primary combustion air travelling through the passage. In one example, primary combustion air traveling in the primary combustion air passage 102 is preheated to about 300° F. before reaching the larger openings 108 forming primary combustion air outlets. The primary combustion air feeds primary combustion in the combustion chamber 52. Preheating the primary combustion air provides a more complete and cleaner primary fuel burn. Because the larger openings 108 which deliver the primary combustion air are positioned at the front of the combustion chamber 50, the fuel burns, beginning at the front of the combustion chamber and progressing to the rear of the combustion chamber. Ashes resulting from the burning fuel fall into the ash collection chamber 68. Other products of combustion, including heat, gases, and particulates, rise in the combustion chamber 52 due to convection. As will be appreciated by those skilled in the art, combustion in the chamber results in air being drawn through the air blower 60 when the blower is not energized to maintain a lower level of combustion.

To achieve a complete burn of the fuel, secondary combustion air is delivered to an upper portion of the combustion chamber 52 via the secondary combustion air passage 104. The secondary combustion air passage 104 is exposed to combustion gases inside the combustion chamber 52 to preheat secondary combustion air travelling through the passage. In one example, air traveling in the secondary combustion air passage 104 is preheated to about 500° F. before reaching the openings 112. The preheated secondary combustion air assists in achieving a better secondary combustion to provide a cleaner, more complete burn of fuel before the products of combustion leave the combustion chamber 52. In the illustrated embodiment, the secondary combustion air openings 112 are arranged along each side and the bottom of the secondary combustion air passage 104 to deliver a relatively uniform distribution of secondary combustion air along the length of the combustion chamber 52 from front to back. It is envisioned that the openings 112 can be made in different sizes so they increase in size along the length of the passage 104 to provide even air distribution or another distribution that provides optimal burn characteristics. The secondary combustion air fuels combustion of combustible by-products remaining after primary combustion (e.g., carbon monoxide) before exiting the combustion chamber 52 and entering the post-combustion chamber 54.

The combustion chamber 52 and post-combustion chamber 54 are separated by insulative panels 90 that maintain a high temperature in the combustion chamber to provide cleaner post-combustion gases in the post-combustion chamber. The insulative panels are arranged so hot post-combustion gases leave the combustion chamber 52 and enter the post-combustion chamber 54 adjacent the front of the firebox 50. The arrangement of the primary and secondary combustion air passage openings, as well as, the position of the passage between the combustion chamber 52 and the post-combustion chamber 54 are chosen to provide a longer residence time for products of combustion in the combustion chamber and thus more time for secondary combustion to achieve a more complete burn. As illustrated by arrows in FIG. 4, primary combustion air enters at the front of the combustion chamber 52, promoting fuel burn from front to back and air flow from front to back. As the fuel burns from front to rear, the products of combustion accumulate toward the back of the combustion chamber 52 and rise before being drawn forward toward the entrance to the post-combustion chamber 54. As the products of combustion move forward toward the post-combustion chamber 54 entrance, the products of combustion travel along the length of the secondary combustion air passage, providing secondary combustion air to the products for an extended time. Optimally, complete combustion is achieved by the time the products of combustion exit the combustion chamber 52 and enter the post-combustion chamber. The combustion air delivery system 62 is configured to deliver variable amounts of primary and secondary combustion air to the combustion chamber 52. The amounts of combustion air delivered depend upon whether the blower 60 is energized or not. In general, increased temperature in the combustion chamber 52 is associated with increased products of combustion, which require increased amounts of secondary combustion air for a complete burn. When the blower 60 is energized so the furnace 20 is operating in a forced draft mode, the combustion air delivery system 62 actively forces air into the combustion chamber 52 through the primary and secondary combustion air passages 102, 104. As explained above, the furnace 20 fully burns the fuel when in the forced draft mode to minimize emissions. When the blower 60 is not energized so the furnace 20 is operating in a natural draft mode, air is drawn into the combustion chamber 52 through the blower 60 by natural draft. When in the natural draft mode, sufficient air is drawn into the combustion chamber 52 to maintain combustion. Further, sufficient secondary air is drawn through the secondary combustion air passage 104 to achieve a clean burn. It will be appreciated that the amount of secondary combustion air needed to achieve complete burn may vary by furnace design. It should be appreciated that the fire burns hotter when the furnace 20 is in the forced draft mode and more post-combustion gas is delivered to the post-combustion chamber 54. Conversely, the fire burns cooler when the furnace 20 is in the natural draft mode and less post-combustion gas is delivered to the post-combustion chamber 54. For example, when the furnace 20 is in the forced draft mode, post-combustion gas having a temperature of about 700° F. might be delivered to the post-combustion chamber 54 at a flowrate of about 0.06 inch of water column, and when in the natural draft mode, post-combustion gas having a temperature of about 300° F. might be delivered to the post-combustion chamber 54 at a flowrate of about 0.03 inch of water column. Therefore, the amount of post-combustion gas produced can be varied with demand as will be explained below.

Post-combustion gases entering the post-combustion chamber 54 flows generally rearward from the front of the firebox 50 to the exhaust part 56. These gases heat the sides and top of the post-combustion chamber 54 forming heat exchanger surfaces that transfer heat from the post-combustion gases to air traveling through upper portions of the passages 76 formed between each side of the firebox 50 and the corresponding side wall 36, 38 of the housing 22 and flowing through the upper plenum 78. It is envisioned that various surface treatments (e.g., high transmissivity coatings) and additional elements (e.g., pins and fins) could be used an inner and outer surfaces of the post-combustion chamber 54 to improve heat transfer. When energized, the fan 70 blows the air directly into the lower plenum 74 of the furnace 50. The air moves upward from the lower plenum 74 through passages 76 formed between each side of the firebox 50 and the corresponding side wall 36, 38 of the housing 22. The air passing through the lower plenum 74 and the passages 76 insulates and cools the corresponding lower wall 26 and the left and right-side walls 36, 38 of the housing 22. As the air passes the exposed sides of the post-combustion chamber 54 forming the upper parts of the passages 76 and lower surface of the upper plenum 78, the air is heated as explained above before passing through the duct connection ports 80 in the upper wall 24 of the housing 22. The ports 80 are configured to connect to heating ductwork (not shown) that transports the heated air to the space being heated.

Figure 7:
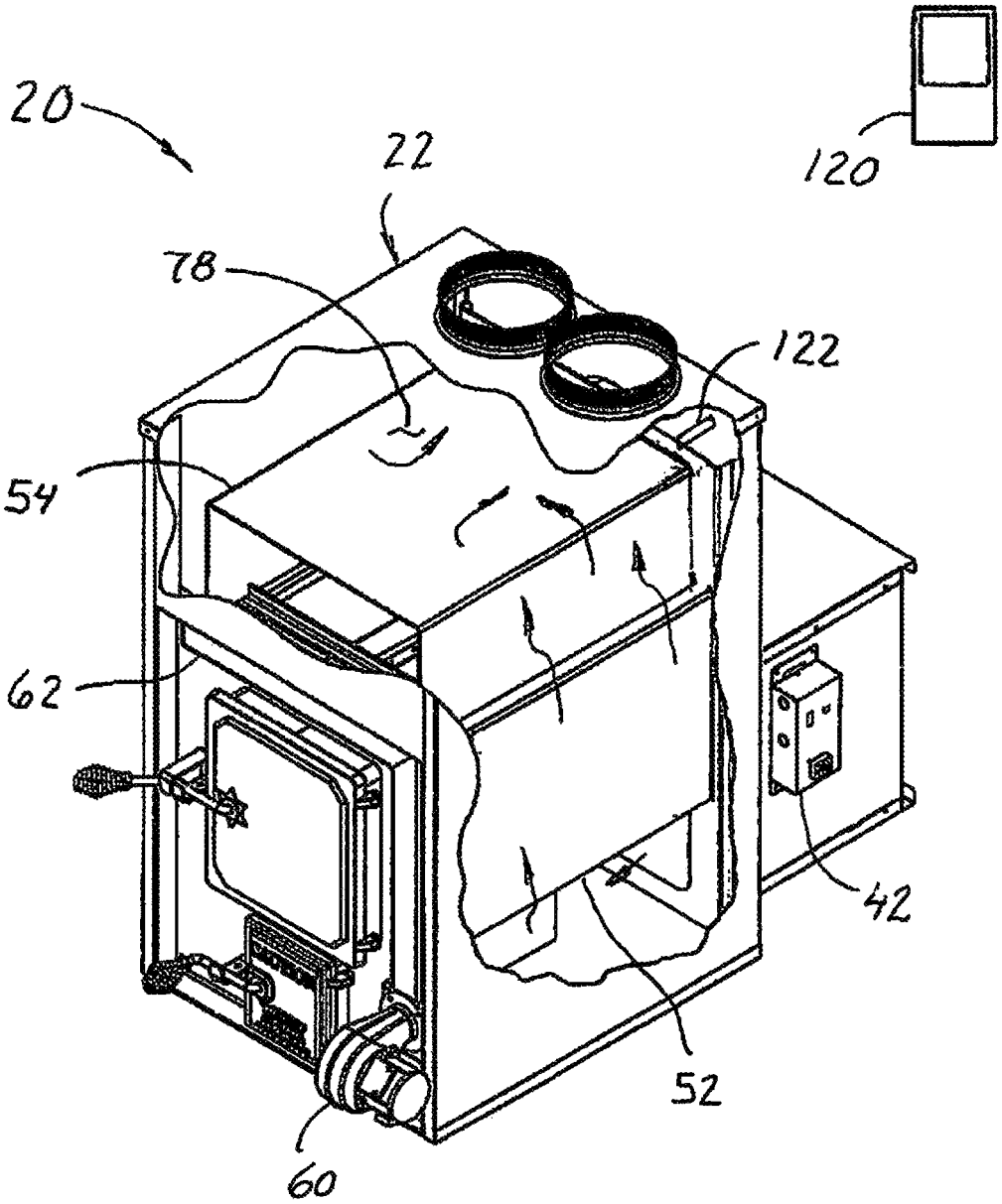
FIG. 7 is a front perspective of the furnace partially broken away to show internal features and components.

In operation, a wood fuel source is loaded in the combustion chamber 52, and the fuel is ignited. As illustrated in FIG. 7, a user sets a conventional thermostat 120 positioned in the space to a desired air temperature. When the air temperature is below a lower limit (e.g., the desired air temperature or a temperature no more than a few degrees below the desired air temperature), the thermostat 120 signals the fan control 42 using conventional means such as an electrical signal indicating heated air is needed to warm the air in the space to the desired air temperature. In response to the signal from the thermostat 120, the fan control 42 energizes the air blower 60 mounted on the combustion air delivery system 62 so more primary and secondary combustion air is delivered to the combustion chamber 52. When more primary and secondary combustion air is delivered to the combustion chamber 52, the temperature and amount of heated air delivered to the post-combustion chamber 54 increases, which increases the temperature of air in the upper plenum 78. A thermal sensor 122 such as a model L4064B2228/B sensor sold by Honeywell International Inc. is mounted on the furnace housing 22 so its probe extends into the upper plenum 78 to measure the temperature of air in the upper plenum and sends a signal (e.g., an electrical signal) corresponding to the measured temperature to the fan control 42. When the temperature of the air sensed by the thermal sensor 122 reaches a selected fan temperature (e.g., the desired air temperature or a temperature a few degrees above the desired air temperature), the fan control component of sensor 122 (broadly, a fan control) energizes the forced-air fan 70 to draw cooler air from the space through cold air return ductwork and blow the air through the housing 22. As explained above, the air passes through the lower plenum 74, the passages 76, and the upper plenum 78 and is heated. The heated air exits the furnace 20 through the duct connection ports 80, which are connected to heating ductwork that transports the heated air to the space and heats the space. It is envisioned that the fan control component of sensor 122 may also be configured to energize the forced-air fan 70 when the temperature of the air sensed by the thermal sensor 122 reaches a selected maximum temperature limit so cooler air is blown through the housing 22 to cool the furnace to prevent damage due to excessive heat. It will be also appreciated that the fan control component of sensor 122 may be operable in a manual setting, in which the forced-air fan 70 runs continuously to circulate air from the space, through the furnace 20 and back to the space.

When the air temperature is below an upper limit (e.g., the desired air temperature or a temperature a few degrees above the desired air temperature), the thermostat 120 signals the fan control 42 indicating the space has reached the desired air temperature to which the thermostat 120 is set. In response to this signal, the fan control 42 de-energizes the air blower 60 so the furnace 20 is in the natural draft mode. Smaller amounts of primary and secondary combustion air are drawn into the combustion chamber 52 so the temperature and amount of heated air delivered to the post-combustion chamber 54 decreases. The fan control component of sensor 122 may continue to energize the forced-air fan 70 so long as the temperature measured by the thermal sensor 122 senses air inside the upper plenum is above the low temperature limit. When the temperature of the air sensed by the thermal sensor 122 drops to a lower limit, the fan control component of sensor 122 de-energizes the forced-air fan 70 so cooler return air is not drawn through from the space and air is not blown through the furnace 20 and heating ductwork that transports the heated air to the space.

Notably, the probe of the temperature sensor 122 is positioned in the upper plenum 78 rather than the combustion chamber 52. Temperatures in the combustion chamber 52 can fluctuate sharply when the air blower 60 is energized. By sensing temperature in the upper plenum 78, the sharp temperature fluctuations are moderated, providing less erratic temperature measurements to the fan control 42 and less air blower 60 and forced-air fan 70 cycling.

There are distinct advantages to achieving the desired amount of secondary combustion air and the desired ratio of secondary to primary combustion air by the structural design of the combustion air delivery system 62. The illustrated furnace 20 requires only rudimentary controls for determining when the air blower 60 and forced-air fan 70 are energized and de-energized. The desired ratio of secondary to primary combustion air, as well as, the desired flowrates of the primary and secondary combustion air are achieved without complex electronic controls so furnace durability and reliability are improved. Fewer electronically controlled components improve ease of use for the consumer and reduce required maintenance. Should power fail, the furnace automatically returns to the natural draft mode so low emissions are maintained. Moreover, the furnace 20 eliminates the need for catalytic systems, resulting in lower emissions at lower combustion chamber temperature, less maintenance, and less opportunity for failure. Nonetheless, it is envisioned the furnace could be modified to have a more complex electronic control and/or a catalytic system if indicated.

It will be understood that other combustion air delivery systems can be used. The various components can have other forms, and components can be omitted. For example, the combustion air delivery system 62 could have other configurations and flowrates. Further, the insulative panels may be firmed from vermiculite, fire bricks, or calcium silicate. Other materials including other types of steel may be used in the furnace construction. For example, ceramics or stainless steel, which can withstand higher temperatures and provide better corrosion resistance could be used. Other heat exchanger configurations are also envisioned.

The combustion air delivery system 62, as well as, the post-combustion chamber 54, the upper plenum 78 and passages 76 are arranged and sized to provide appropriate airflows through the furnace 20 and to provide efficient heat transfer. The furnace 20 may be used as a sole source for heating the interior of a building, a plurality of rooms of a building, or even an outdoor space. The size of the combustion chamber 52 in combination with various other features of the furnace 20 described above produce a furnace capable of heating large spaces with good efficiency and significantly lower emissions of particulates and carbon monoxide. In general, the furnace 20 is suited to achieve nearly complete fuel burn compared to conventional wood burning furnaces. Further, heat generated in the furnace 20 is efficiently transferred from the combustion gases to air traveling through the furnace for heating a space.

As will be appreciated by those skilled in the art, aspects of the present disclosure can be adapted for use in other types of furnaces. For example, aspects of the disclosure can be used for outdoor furnaces, furnaces that burn other types of fuel, and furnaces that heat fluid other than air.

It will be appreciated by those skilled in the art, various aspects of the described furnace can be modified. For example, features can be omitted or have other forms. Moreover, it will be appreciated that the dimensions noted herein are provided by way of example and not as a limitation.

Having described the disclosure in detail, it will be apparent that modifications and variations are possible without departing from the scope of the appended claims.

When introducing elements of the present disclosure or the preferred embodiment(s) thereof the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions, products, and methods without departing from the scope of the disclosure, it is intended that all matter contained in the above description and shown in the accompanying drawings shall be interpreted as illustrative and not in a limiting sense.

What is claimed is:

1. A forced-air furnace, comprising:

a housing having a top, a bottom opposite said top, a front, a back opposite said front, and opposite sides extending between said top and said bottom and between said front and said bottom;

a firebox in the housing having a combustion chamber adapted for receiving fuel to be combusted and producing products of combustion, the combustion chamber including a front face adjacent the front of the housing, a rear face opposite the front face, a top face below which the fuel is combusted and a bottom face above which the fuel is combusted; and a combustion air delivery system for delivering combustion air to the combustion chamber, the combustion air delivery system including:

a manifold extending vertically along the front face of the combustion chamber from a lower end to an upper end;

an air blower mounted on the manifold for blowing air through the manifold from the lower end to the upper end;

a primary combustion air passage in fluid communication with the lower end of the manifold for delivering air from the air blower to a primary combustion air outlet entering the combustion chamber exclusively at the front face of the combustion chamber adjacent the bottom face of the combustion chamber for delivering primary combustion air to the combustion chamber during combustion, burning the fuel and forming products of combustion, a lower half of the combustion chamber being free of combustion air outlets at the rear face of the combustion chamber; and a secondary combustion air passage in fluid communication with the lower end of the manifold for delivering air from the air blower to a secondary combustion air outlet positioned inside the combustion chamber adjacent the top face of the combustion chamber for delivering secondary combustion air to the combustion chamber, burning a portion of the products of combustion.

2. A forced-air furnace as set forth in claim 1, further comprising a fan control adapted to energize and de-energize the air blower in response to an input signal, energizing the air blower to blow air through the manifold to increase air temperature inside the firebox and de-energizing the air blower to decrease air temperature inside the firebox.

3. A forced-air furnace as set forth in claim 2, wherein when the air blower is de-energized, air is drawn into the combustion chamber through the primary combustion air outlet by natural draft to maintain combustion.

4. A forced-air furnace as set forth in claim 1, wherein the firebox has a post-combustion chamber mounted above the combustion chamber directing products of combustion from the combustion chamber to an exhaust port mounted on the housing and configured to connect to a vent for transporting the products of combustion away from the furnace, and the furnace further comprises:

a plenum adjacent the post-combustion chamber for transferring heat from the products of combustion to air traveling through the plenum; and a forced-air fan having an inlet in fluid communication with air outside the housing and an outlet in fluid communication with the plenum for forcing air through the plenum air.

5. A forced-air furnace as set forth in claim 4, further comprising:

a temperature sensor positioned for sensing air temperature inside the plenum; and a fan control adapted to energize and de-energize the forced-air fan in response to temperature sensed inside the plenum, energizing the forced-air fan to blow air through the plenum when temperature sensed inside the plenum is above a selected low temperature limit.

6. A forced-air furnace as set forth in claim 5, wherein the fan control de-energizes the forced-air fan when temperature sensed inside the plenum is below a selected lower limit.

7. A forced-air furnace as set forth in claim 5, wherein the fan control energizes the forced-air fan when temperature sensed inside the plenum is above a selected maximum temperature limit.

8. A forced-air furnace as set forth in claim 4, wherein the forced-air fan is positioned outside the housing, and the furnace further comprises a passage fluidly connected between the forced-air fan and the plenum.

9. A forced-air furnace as set forth in claim 8, wherein:

the forced-air fan forces air into the housing through an inlet positioned in the back of the housing adjacent the bottom of the housing; and the passage passes between the housing and the combustion chamber.

10. A forced-air furnace as set forth in claim 4, wherein:

the inlet of the forced-air fan is in fluid communication with cold air return ductwork of a building; and the plenum is in fluid communication with heating ductwork of the building.

11. A forced-air furnace as set forth in claim 1, wherein:

the combustion chamber includes a door covering an opening in the front face for loading the combustion chamber with solid fuel; and the primary combustion air outlet enters the combustion chamber along one side of the opening.

12. A forced-air furnace comprising:

a housing having a top, a bottom opposite said top, a front, a back opposite said front, and opposite sides extending between said top and said bottom and between said front and said bottom;

a firebox in the housing having a combustion chamber adapted for receiving fuel to be combusted and producing products of combustion, the combustion chamber including a front face adjacent the front of the housing, a rear face opposite the front face, a top face below which the fuel is combusted and a bottom face above which the fuel is combusted, said firebox having a post-combustion chamber positioned above the combustion chamber, the post-combustion chamber receiving products of combustion from the combustion chamber exclusively adjacent the front face of the combustion chamber and transporting the products of combustion to an exhaust port adjacent a back of the housing;

a lower plenum fluidly segregated from the combustion chamber positioned below the combustion chamber;

a forced-air fan adapted to selectively blow air into the lower plenum;

a pair of passages, each passage of said pair of passages transporting air upward from the lower plenum along a corresponding opposite side of the combustion chamber; and an upper plenum fluidly segregated from the post-combustion chamber partially surrounding the post-combustion chamber for transferring heat from the products of combustion in the post-combustion chamber to air travelling through the upper plenum, the upper plenum including lower portions on opposite sides of the post-combustion chamber and an upper portion above the post-combustion chamber having a duct connection port adjacent the rear wall of the housing through which air exits the upper plenum, each of the lower portions of the upper plenum receiving air from a corresponding passage of said pair of passages and directing the received air upward along the corresponding side of the post-combustion chamber to the upper portion, the upper portion directing air from the lower portions of the upper plenum rearward to the duct connection port.

13. A forced-air furnace as set forth in claim 12, further comprising:

a temperature sensor positioned for sensing air temperature inside the upper plenum; and a fan control adapted to energize and de-energize the forced-air fan in response to temperature sensed inside the upper plenum, energizing the forced-air fan to blow air through the upper plenum when temperature sensed inside the upper plenum is above a selected low temperature limit.

14. A forced-air furnace as set forth in claim 13, wherein the fan control de-energizes the forced-air fan when temperature sensed inside the upper plenum is below a selected lower limit.

15. A forced-air furnace as set forth in claim 13, wherein the fan control energizes the forced-air fan when temperature sensed inside the upper plenum is above a selected maximum temperature limit.

16. A forced-air furnace as set forth in claim 12, further comprising:

a combustion air delivery system for delivering combustion air to the combustion chamber, the combustion air delivery system including:

a manifold mounted outside the combustion chamber and extending vertically along the front face of the combustion chamber from a lower end to an upper end;

an air blower mounted on the manifold for blowing air through the manifold from the lower end to the upper end;

a primary combustion air passage in fluid communication with the lower end of the manifold for delivering air from the air blower to a primary combustion air outlet entering the combustion chamber exclusively at the front face of the combustion chamber adjacent the bottom face of the combustion chamber for delivering primary combustion air to the combustion chamber during combustion, burning the fuel and forming products of combustion; and a secondary combustion air passage in fluid communication with the lower end of the manifold for delivering air from the air blower to a secondary combustion air outlet positioned inside the combustion chamber adjacent the top face of the combustion chamber for delivering secondary combustion air to the combustion chamber, burning a portion of the products of combustion.

17. A forced-air furnace as set forth in claim 16, further comprising a fan control adapted to energize and de-energize the air blower in response to an input signal, energizing the air blower to blow air through the manifold to increase air temperature inside the firebox and de-energizing the air blower to decrease air temperature inside the firebox.

18. A forced-air furnace as set forth in claim 17, wherein when the air blower is de-energized, air is drawn into the combustion chamber through the primary combustion air outlet by natural draft to maintain combustion.

* * * * *